US009062681B2

(12) United States Patent
Lee et al.

(10) Patent No.: US 9,062,681 B2
(45) Date of Patent: Jun. 23, 2015

(54) FAN DEVICE AND VANE THEREOF

(71) Applicant: MSI Computer (Shenzhen) Co., Ltd., Shenzhen, Guangdong Province (CN)

(72) Inventors: Lin-Yu Lee, New Taipei (TW); Shang-Chih Yang, New Taipei (TW)

(73) Assignee: MSI COMPUTER (SHENZHEN) CO., LTD., Shenzhen, Guangdong Province (CN)

( * ) Notice: Subject to any disclaimer, the term of this patent is extended or adjusted under 35 U.S.C. 154(b) by 420 days.

(21) Appl. No.: 13/644,959

(22) Filed: Oct. 4, 2012

(65) Prior Publication Data

US 2014/0030104 A1 Jan. 30, 2014

(30) Foreign Application Priority Data

Jul. 27, 2012 (CN) ..... 2012 2 0368765 U

(51) Int. Cl.
*F04D 29/32* (2006.01)
*F04D 19/00* (2006.01)

(52) U.S. Cl.
CPC ..... *F04D 19/007* (2013.01); *F04D 29/327* (2013.01)

(58) Field of Classification Search
CPC ... F04D 19/007; F04D 19/002; F04D 29/327; F04D 29/328; F04D 29/666; F04D 29/384
USPC ..... 415/199.4; 416/231 B, 175, 198 R, 416/200 R, 201 A, 203
See application file for complete search history.

(56) References Cited

U.S. PATENT DOCUMENTS 7,025,569 B2 * 4/2006 Chang et al. ..... 416/183
2008/0247868 A1 * 10/2008 Lan et al. ..... 415/182.1

OTHER PUBLICATIONS

"Chi-Feng fan products comparison", http://bak1.beareyes.com.cn/2/lib/200107/10/20010710055.htm, downloaded Jun. 1, 2012, 5 pages.

* cited by examiner

*Primary Examiner* — Richard Edgar
(74) *Attorney, Agent, or Firm* — Muncy, Geissler, Olds & Lowe, P.C.

(57) ABSTRACT

A fan device includes a frame including an axle base and a vane including a hub disposed on the axle base pivotally and blade assemblies disposed circumferentially on the sidewall surface. The hub includes a windward side and a sidewall surface. Each blade assemblies includes a first blade and a second blade protruded from the sidewall surface radially. The second blade is farther away than the first blade from the windward side. The angle of between an extending surface of a second side edge of the second blade extending and the windward side is greater than another angle of between an extending surface of a first side edge of the first blade extending and the windward side. The gap between the partial second side edge and the windward side is less than another gap between the first side edge and the windward side.

7 Claims, 7 Drawing Sheets

FAN DEVICE AND VANE THEREOF

CROSS-REFERENCE TO RELATED APPLICATIONS

This non-provisional application claims priority under 35 U.S.C. §119(a) on Patent Application No(s). 201220368765.7 filed in China, P.R.C. on Jul. 27, 2012, the entire contents of which are hereby incorporated by reference.

BACKGROUND

1. Technical Field

The present disclosure relates to a heat dissipation device, and more particularly, to a fan device and a vane thereof 2. Related Art With the development of electronic industry technology, the performance of an electronic element manufactured has been gradually enhanced. However, generally speaking, when the performance of the electronic element is enhanced, heat generated by the electronic element is increased as well, which makes the temperature of the electronic element rise. When the heat of the electronic element may not be removed for cooling the electronic element, the electronic element may be failed or even fired. Therefore, in the electronic industry, how to remove the heat from the electronic element effectively is much more important than improving the performance of the electronic element.

In general, the heat from the electronic element is transferred by a liquid-cooling heat exchanger or an air-cooling heat exchanger so that the heat generated by the electronic element may be removed. The liquid-cooling heat exchanger is that a cooling fluid in a cooling tube is driven by a compressor or a pump to perform heat transfer with the electronic element to remove the heat from the electronic element. The air-cooling heat exchanger is used for enabling a fan to guide air to flow through the electronic element so that the heat from the electronic element may be removed. Compared with the liquid-cooling heat exchanger, the air-cooling heat exchanger does not include the compressor, the pump and the cooling fluid, which advances in manufacturing and operating cost. Therefore the air-cooling heat exchanger is generally adopted to remove the heat from the electronic element.

However, the general air-cooling heat exchanger may not remove greater heat when applied to high-level electronic elements. Under consideration for manufacturing and operating cost and heat dissipating benefit, an air-cooling heat exchanger with higher heat dissipating performance needs to be developed.

SUMMARY

An embodiment discloses a fan device, comprising a frame and a vane. The frame includes an axle base. The vane comprises a hub and a plurality of blade assemblies. The hub is disposed on the axle base in a pivotal way and includes a windward side and a sidewall surface connected to the windward side. The blade assemblies are circumferentially disposed on the sidewall surface. Each of the blade assemblies includes a first blade and a second blade. The first blade and the second blade both are disposed on and protruded from the sidewall surface of the hub in a radial direction. The distance between the second blade and the windward side is greater than another distance between the first blade and the windward side. The first blade includes a first side edge away from the windward side and connected to the sidewall surface. The second blade includes a second side edge near the windward side and connected to the sidewall surface. The angle of between an extending surface of the second side edge of the second blade extending towards the windward side and the windward side is greater than another angle of between an extending surface of the first side edge of the first blade extending towards the windward side and the windward side. The gap between a portion of the second side edge and the windward side is less than another gap between the first side edge and the windward side.

Another embodiment discloses a vane for being disposed on a frame including an axle base. The vane comprises a hub and a plurality of blade assemblies. The hub is disposed on the axle base in a pivotal way and includes a windward side and a sidewall surface connected to the windward side. The blade assemblies are circumferentially disposed on the sidewall surface. Each of the blade assemblies includes a first blade and a second blade. The first blade and the second blade both are disposed on and protruded from the sidewall surface of the hub in a radial direction. The distance between the second blade and the windward side is greater than another distance between the first blade and the windward side. The first blade includes a first side edge away from the windward side and connected to the sidewall surface. The second blade includes a second side edge near the windward side and connected to the sidewall surface. The angle of between an extending surface of the second side edge of the second blade extending towards the windward side and the windward side is greater than another angle of between an extending surface of the first side edge of the first blade extending towards the windward side and the windward side. The gap between a portion of the second side edge and the windward side is less than another gap between the first side edge and the windward side.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

The detailed features and advantages of the disclosure are described below in great detail through the following embodiments, the content of the detailed description is sufficient for those skilled in the art to understand the technical content of the present disclosure and to implement the disclosure there accordingly. Based upon the content of the specification, the claims, and the drawings, those skilled in the art can easily understand the relevant objectives and advantages of the disclosure.

Figure 1:
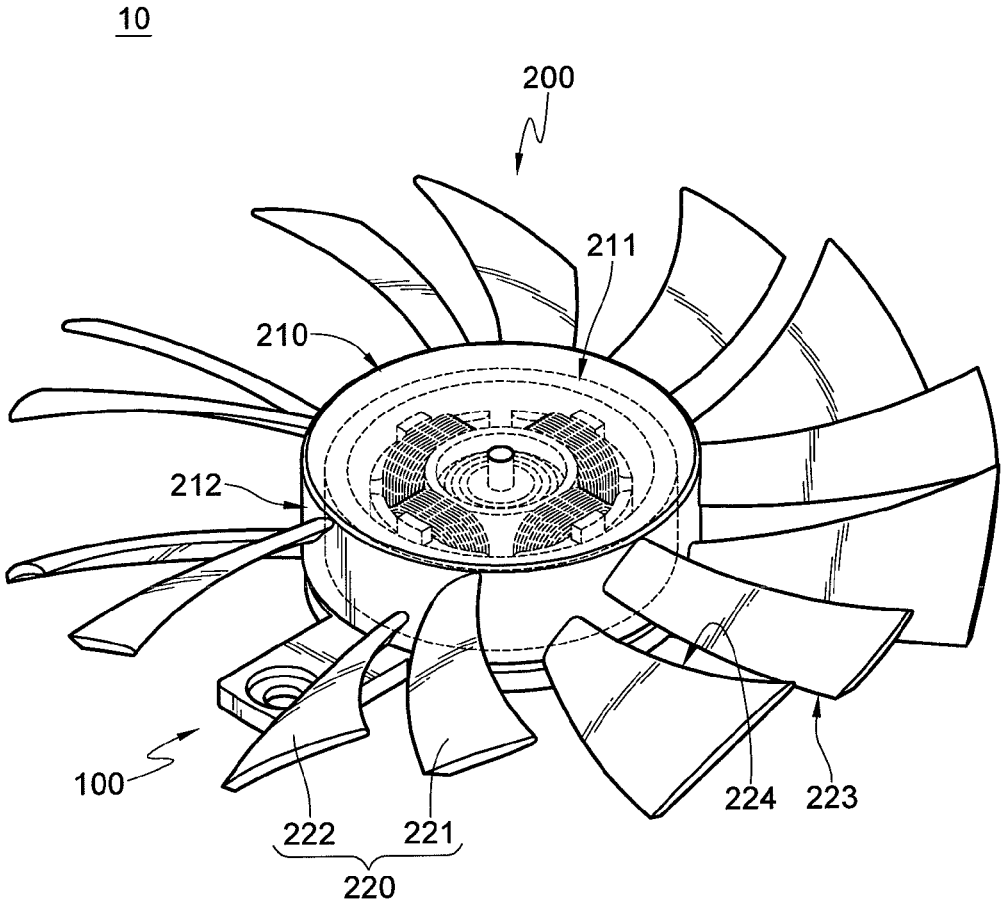
FIG. 1 is a schematic perspective view of a fan device according to an embodiment.
Figure 2:
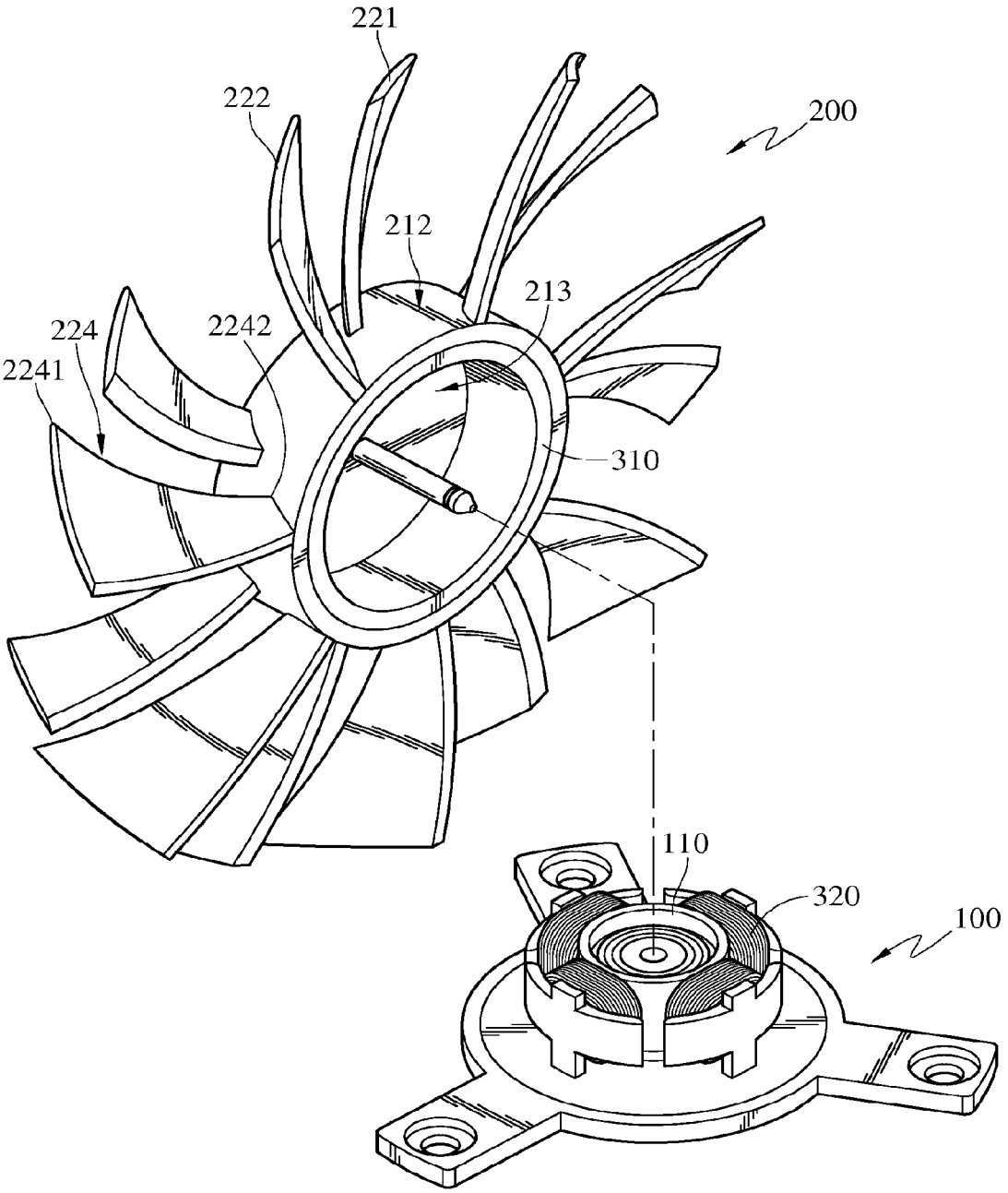
FIG. 2 is a schematic exploded view of the fan device in FIG. 1.
Figure 3:
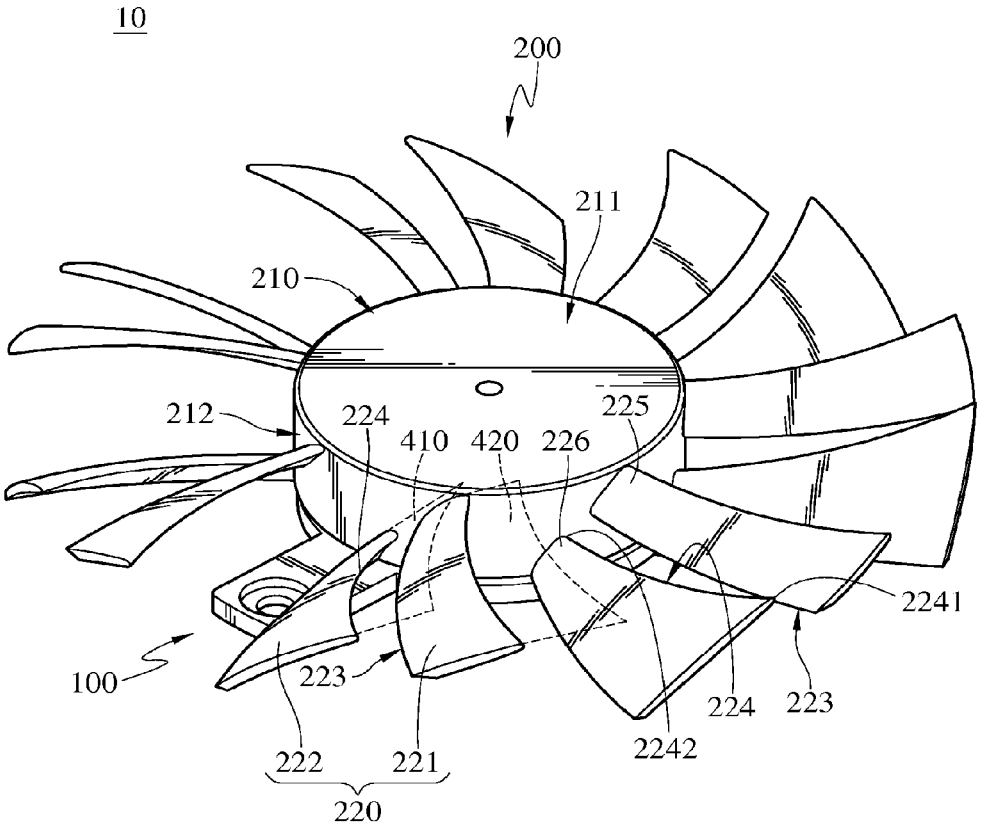
FIG. 3 is a schematic perspective view of a first blade and an extending surface of a second blade in FIG. 1.
Figure 4:
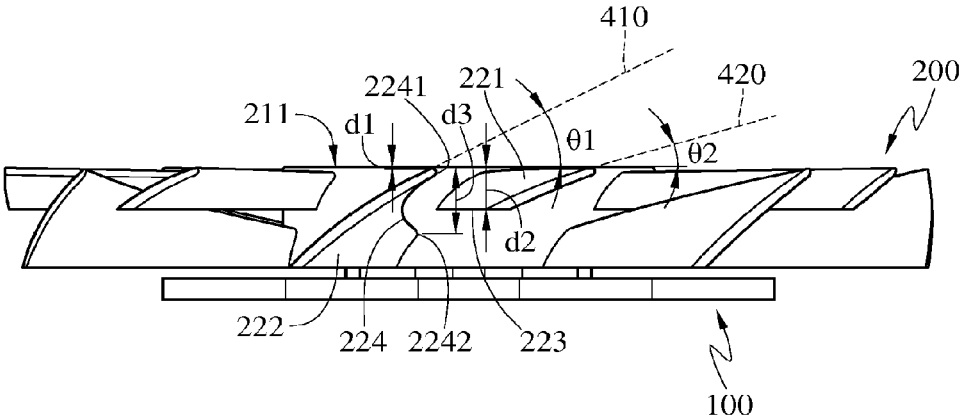
FIG. 4 is a schematic perspective side view of a first blade and an extending surface of a second blade in FIG. 1.
Figure 5:
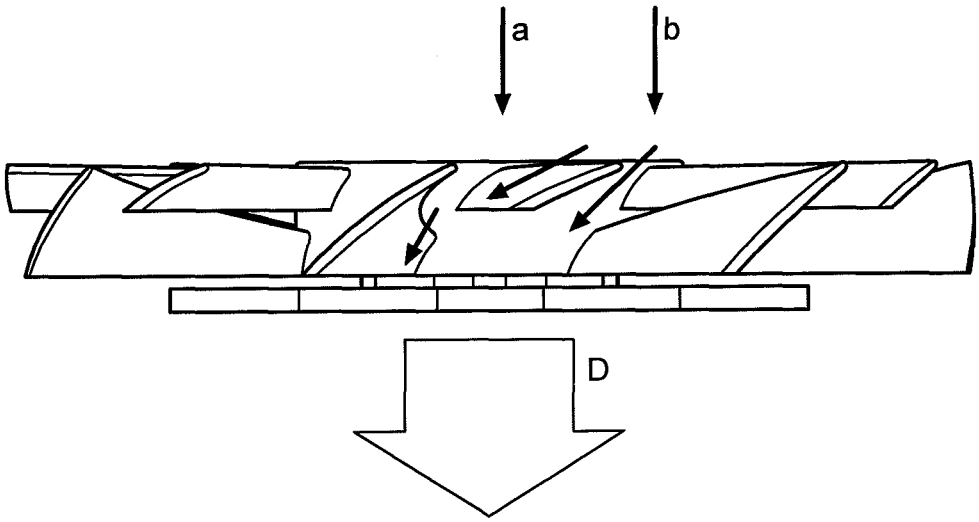
FIG. 5 is a view of airflows according to an embodiment in FIG. 4.

Please refer to FIGS. 1 to 5 together. FIG. 1 is a schematic perspective view of a fan device according to an embodiment. FIG. 2 is a schematic exploded view of a fan device in FIG. 1. FIG. 3 is a schematic perspective view of a first blade and an extending surface of a second blade in FIG. 1. FIG. 4 is a schematic perspective side view of a first blade and an extending surface of a second blade in FIG. 1. FIG. 5 is a view of airflow according to an embodiment in FIG. 4.

A fan device 10 according to this embodiment comprises a frame 100 and a vane 200. The frame 100 includes an axle base 110. The vane 200 includes a hub 210 and multiple blade assemblies 220. The hub 210 is disposed on the axle base 110 in a pivotal way and includes a windward side 211 and a sidewall surface 212. The sidewall surface 212 is connected to the windward side 211. Moreover, the hub 210 includes a container 213, and the sidewall surface 212 of the hub 210 surrounds the container 213.

The multiple blade assemblies 220 are disposed on the sidewall surface 212 of the hub 210 circumferentially. Also, the adjacent blade assemblies 220 form and keep the same angle with each other. In some embodiments, each of the blade assemblies 220 includes a first blade 221 and a second blade 222. The first blade 221 and the second blade 222 are both disposed on the sidewall surface 212 of the hub 210. The first blade 221 and the second blade 222 are both protruded from the sidewall surface 212 of the hub 210 towards outside in a radial direction. The distance between the second blade 222 and the windward side 211 is greater than another distance between the first blade 221 and the windward side 211. In other words, as for the windward side 211, the second blade 222 is farther away than the first blade 221. In detail, each of the first blades 221 has a base portion 225 and each of the base portions 225 of the first blades 221 is connected to the sidewall surface 212 of the hub 210. Each of the second blades 222 has a base portion 226 and each of the base portions 226 of the second blades 222 is connected to the sidewall surface 212 of the hub 210. The distance between the base portion 225 and the windward side 211 is greater than another distance between the base portion 226 and the windward side 211. In other words, as for the windward side 211, each of the base portions 225 of the first blades 221 is farther away than each of the base portions 226 of the second blades 222. Furthermore, in some embodiments, the surface area of each of the second blades 222 is greater than that of each of the first blades 221, which enhances the flow convergence effect of the second blades 222.

The first blade 221 includes a first side edge 223 away from the windward side 211, and the first side edge 223 is connected to the sidewall surface 212. The second blade 222 includes a second side edge 224 near the windward side 211, and the second blade 222 is connected to the sidewall surface 212. In this embodiment, the second blade 222 includes an extending surface 410 extending towards the windward side 211 from the second side edge 224 (as shown in FIG. 3). The extending surface 410 of the second side edge 224 of the second blade 222 and the windward side 211 form an angle $\theta_1$ together. The first blade 221 includes an extending surface 420 extending towards the windward side 211 from the first side edge 223 (as shown in FIG. 4). The extending surface 420 of the first side edge 223 of the first blade 221 and the windward side 211 form an angle $\theta_2$ together. The angle $\theta_1$ of between the extending surface 410 and the windward side 211 is greater than angle $\theta_2$ of between the extending surface 420 and the windward side 211. Moreover, the gap between a portion of the second side edge 224 and the windward side 211 is less than another gap between the first side edge 223 and the windward side 211. In detail, the shortest distance $d_1$ between the second side edge 224 and the windward side 211 is less than the longest distance $d_2$ between the first side edge 223 and the windward side 211. In other words, a portion of the second side edge 224 of the second blade 222 is higher than the first side edge 223 based on the hub 210 (as shown in FIG. 4).

The vane 200 generates a first airflow and a second airflow b when rotating on the axle base 110 relatively. The first airflow a and the second airflow b both flow towards the windward side 211. However, the angle $\theta_2$ of between the first blade 221 and the windward side 211 is less than the angle $\theta_1$ of between the second blade 222 and the windward side 211, so the first airflow a and the second airflow b are converged to form a downforce flow D by the guidance of the first blade 221 and the second blade 222 in sequence (as shown in FIG. 5). Therefore, the fan device 10 may draw in and converge a large amount of the air to form the downforce flow. Then, the fan device 10 guides the downforce flow to an electronic element heated (not shown) to enhance the heat dissipating efficacy of the fan device 10.

In some embodiments, the fan device 10 comprises a first electromagnetic conduction element 310 and a second electromagnetic conduction element 320. The first electromagnetic conduction element 310 is disposed on the hub 210 and a second electromagnetic conduction element 320 is disposed on the axle base 110. When the first electromagnetic conduction element 310 rotates on the second electromagnetic conduction element 320 relatively, the first electromagnetic conduction element 310 and the second electromagnetic conduction element 320 drive the vane 200 to rotate because of an electromagnetic effect generated by the first electromagnetic conduction element 310 and the second electromagnetic conduction element 320.

Figure 6:
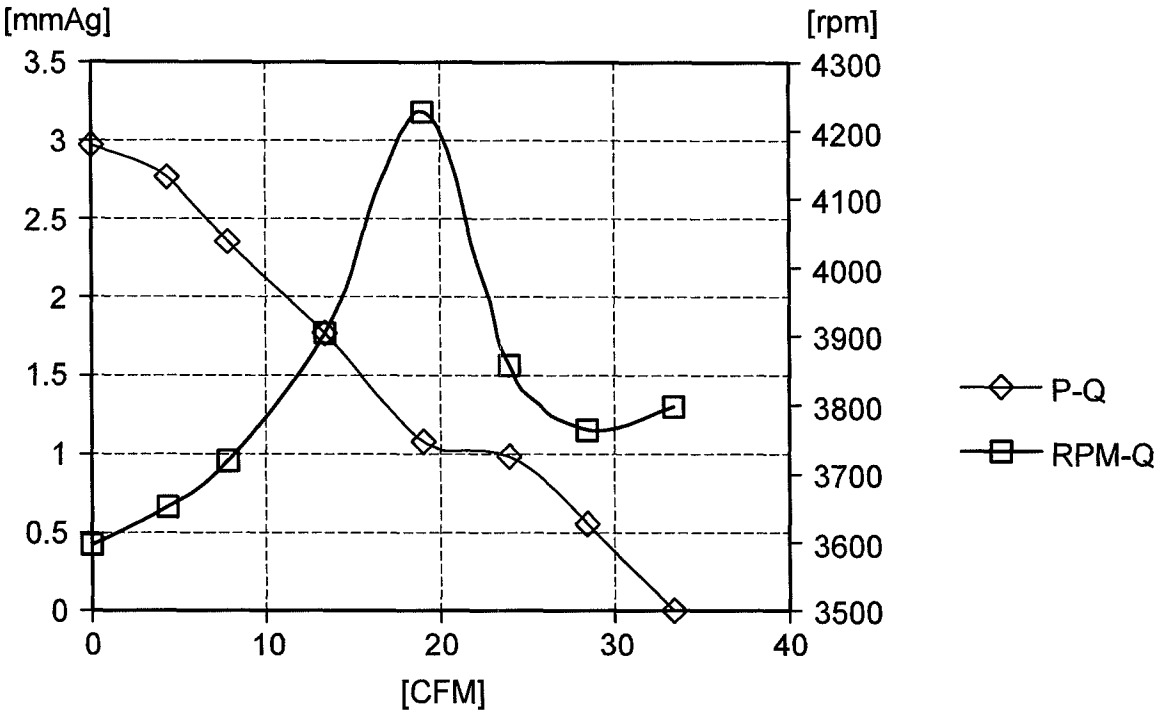
FIG. 6 illustrates the correlations among flow rate, wind pressure and rotation speed of a fan device in FIG. 1.
Figure 7:
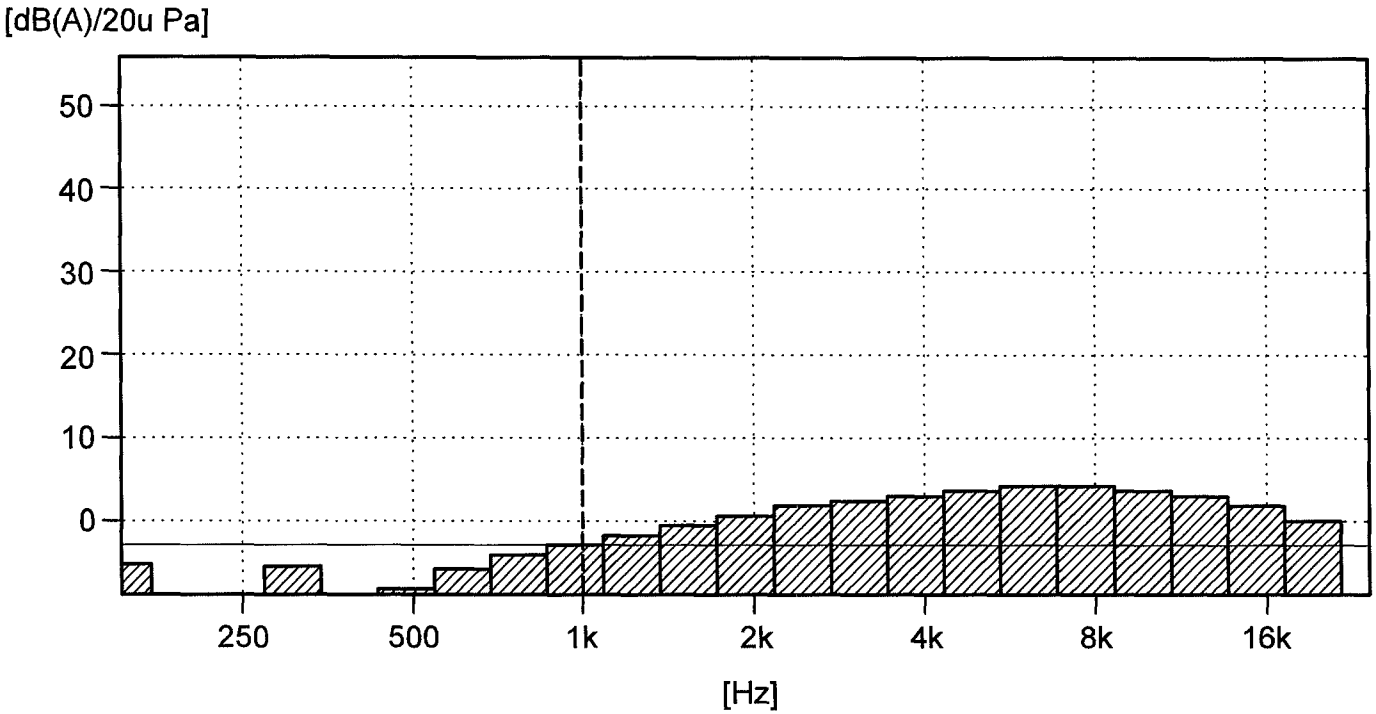
FIG. 7 illustrates noise test data of the fan device in FIG. 1.
Figure 8:
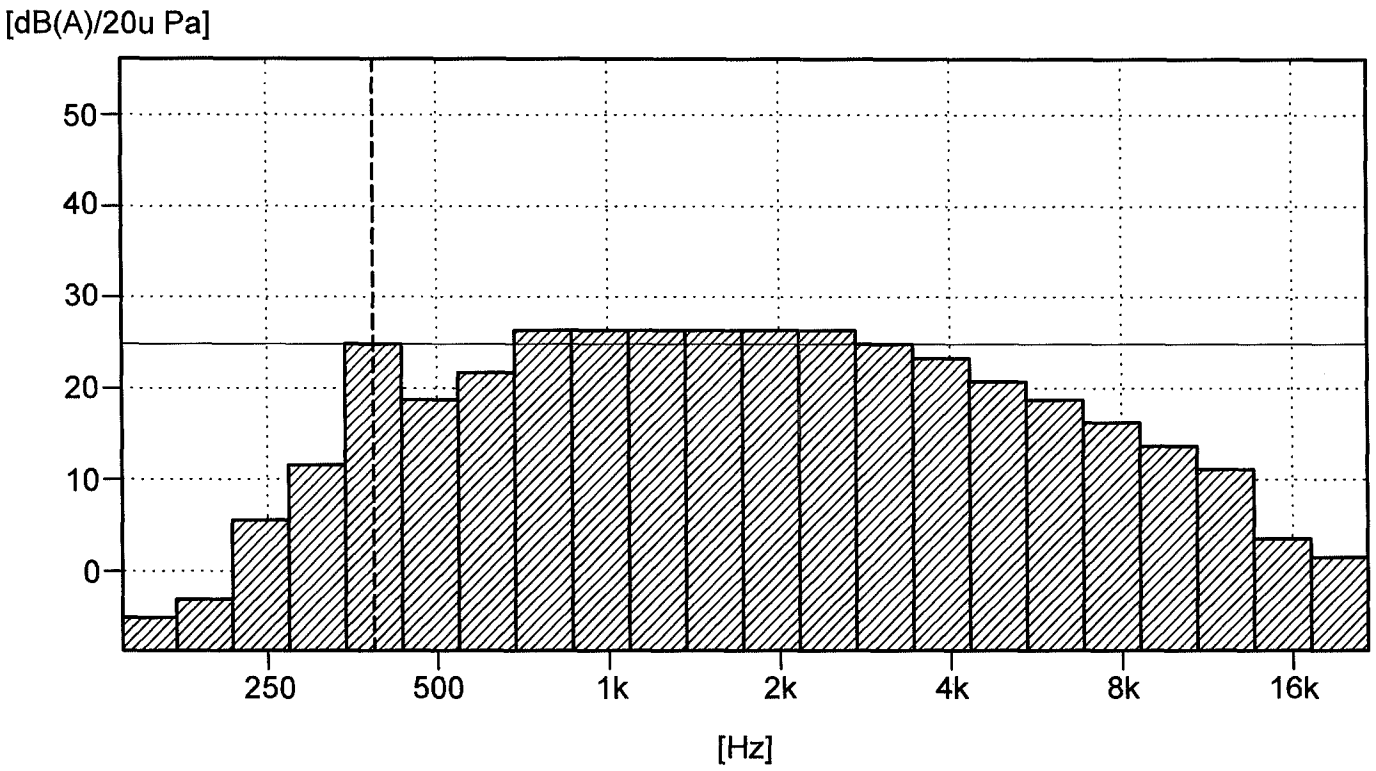
FIG. 8 illustrates another noise test data of the fan device in FIG. 1.

Please refer to FIGS. 6 to 8. FIG. 6 is a diagram illustrates the correlations among flow rate, wind pressure and rotation speed of a fan device in FIG. 1. FIG. 7 is a diagram illustrates noise test data of the fan device in FIG. 1. FIG. 8 is a diagram illustrates another noise test data of the fan device in FIG. 1. As shown in FIG. 6, according to the test result, when the fan device 10 rotates at 3500 revolutions per minute (rpm), the maximum wind pressure may reach 2.97 millimeters Aqua (mmAq, when the point of the flow rate in the wind pressure-flow rate line (P-Q line) is zero). Moreover, the maximum flow rate may reach 33.32 cubic feet per minute (CFM, when the point of the wind pressure in the P-Q line is zero). Furthermore, when the fan device 10 rotates at 3796 rpm, the maximum flow rate may reach 33.32 CFM as well (when the point of the rotation speed in the rotation speed -flow rate line (RPM-Q line) is 3796 rpm).

In addition, the fan device 10 in the embodiment not only enhances the heat dissipating efficacy but also decreases the noise when operating. As shown in FIG. 7, according to the test result, when an audio recording device (i.e. microphone) is positioned one meter away from the fan device 10, the noise value of the fan device 10 with the frequency of the sound of 1 k hertz (Hz) which is measured by the audio recording device is −3 decibels (dB, reference 20 micropascals (μPa)). As shown in FIG. 8, when the fan device 10 rotates at 3500 rpm, and the audio recording device is positioned in the vicinity of the fan device 10 (closer to the fan device 10 than in FIG. 7), the noise value of the fan device 10 with the frequency of the sound of 400 k Hz which the audio recording device measures is only 24.3 dB (re. 20 μPa)).

According to the above-mentioned data, the maximum wind pressure is 2.97 mmAq and the noise value is only 24.3 dB (re. 20 μPa), the fan device which includes the above-mentioned structure has the advantages of better heat dissipating efficacy and quiet operation.

To sum up, the fan device according to the disclosure comprises the blade assemblies and each of the blade assemblies includes the first blade and the second blade. The angle of between the extending surface of the second side edge of the second surface towards the windward side is greater than another angle of between the extending surface of the first side edge of the first surface towards the windward side, and furthermore the gap between a portion of the second side edge and the windward side is less than another gap between the first side edge and the windward side so that the multiple first blade may guide the air flow before the multiple second blades may converge the air flow to generate strong downforce flow when operating, thereby enhancing the heat dissipating efficacy and decreasing the noise.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A fan device, comprising:

a frame including an axle base; and a vane comprising:

a hub disposed on the axle base in a pivotal way and including a windward side and a sidewall surface connected to the windward side; and a plurality of blade assemblies circumferentially disposed on the sidewall surface wherein each of the blade assemblies includes a first blade and a second blade, the first blade and the second blade both are disposed on and protruded from the sidewall surface of the hub in a radial direction, the distance between the second blade and the windward side is greater than another distance between the first blade and the windward side, the first blade includes a first side edge away from the windward side and connected to the sidewall surface, the second blade includes a second side edge near the windward side and connected to the sidewall surface, the angle of between an extending surface of the second side edge of the second blade extending towards the windward side and the windward side is greater than another angle of between an extending surface of the first side edge of the first blade extending towards the windward side and the windward side, and the gap between a portion of the second side edge and the windward side is less than another gap between the first side edge and the windward side;

wherein the second side edge has a free end and a connecting end that are opposite to each other, the connecting end is connected to the hub, a distance between the connecting end and the windward side is less than a distance between the first side edge and the windward side, and a distance between the first side edge and the windward side is less than a distance between the free end and an extending plane of the windward side.

2. The fan device according to claim 1, wherein the surface area of each of the second blades is greater than the surface area of each of the first blades.

3. The fan device according to claim 1, wherein the adjacent blade assemblies form the same angle with each other.

4. The fan device according to claim 1, further comprising a first electromagnetic conduction element disposed on the hub and a second electromagnetic conduction element disposed on the axle base, when the first electromagnetic conduction element rotates in relative to the second electromagnetic conduction element, the first electromagnetic conduction element and the second electromagnetic conduction element drive the vane to rotate because of an electromagnetic effect generated by the first electromagnetic conduction element and the second electromagnetic conduction element.

5. A vane, for being disposed on a frame including an axle base, comprising:

a hub disposed on the axle base in a pivotal way and including a windward side and a sidewall surface connected to the windward side; and a plurality of blade assemblies circumferentially disposed on the sidewall surface wherein each of the blade assemblies includes a first blade and a second blade, the first blade and the second blade both are disposed on and protruded from the sidewall surface of the hub in a radial direction, the distance between the second blade and the windward side is greater than another distance between the first blade and the windward side, the first blade includes a first side edge away from the windward side and connected to the sidewall surface, the second blade includes a second side edge near the windward side and connected to the sidewall surface, the angle of between an extending surface of the second side edge of the second blade extending towards the windward side and the windward side is greater than another angle of between an extending surface of the first side edge of the first blade extending towards the windward side and the windward side, and the gap between a portion of the second side edge and the windward side is less than another gap between the first side edge and the windward side;

wherein the second side edge has a free end and a connecting end that are opposite to each other, the connecting end is connected to the hub, a distance between the connecting end and the windward side is less than a distance between the first side edge and the windward side, and a distance between the first side edge and the windward side is less than a distance between the free end and an extending plane of the windward side.

6. The vane according to claim 5, wherein the surface area of each of the second blades is greater than the surface area of each of the first blades.

7. The vane according to claim 5, wherein the adjacent blade assemblies form the same angle with each other.

* * * * *